US008960571B2

(12) United States Patent
Haruch

(10) Patent No.: US 8,960,571 B2
(45) Date of Patent: Feb. 24, 2015

(54) FULL CONE AIR-ASSISTED SPRAY NOZZLE ASSEMBLY

(75) Inventor: James Haruch, Naperville, IL (US)

(73) Assignee: Spraying Systems Co., Wheaton, IL (US)

( * ) Notice: Subject to any disclaimer, the term of this patent is extended or adjusted under 35 U.S.C. 154(b) by 347 days.

(21) Appl. No.: 13/588,288

(22) Filed: Aug. 17, 2012

(65) Prior Publication Data

US 2014/0048622 A1 Feb. 20, 2014

(51) Int. Cl.

| | |
|---|---|
| ***B05B 7/12*** | (2006.01) |
| ***B05B 7/04*** | (2006.01) |
| ***B05B 7/06*** | (2006.01) |
| ***B05B 1/28*** | (2006.01) |

(52) U.S. Cl.

USPC ..... 239/433; 239/416.4; 239/428; 239/400; 239/290

(58) Field of Classification Search

USPC ..... 239/398, 416.4, 416.5, 429, 433, 464, 239/434.5, 461, 463, 468, 472, 428, 399, 239/400, 290, 291

See application file for complete search history.

(56) References Cited

U.S. PATENT DOCUMENTS

| | | | | |
|---|---|---|---|---|
| 3,642,202 | A * | 2/1972 | Angelo | 239/8 |
| 3,684,186 | A * | 8/1972 | Helmrich | 239/400 |
| 3,979,069 | A * | 9/1976 | Garofalo | 239/400 |
| 4,447,010 | A * | 5/1984 | Maeda et al. | 239/414 |

* cited by examiner

*Primary Examiner* — Justin Jonaitis
(74) *Attorney, Agent, or Firm* — Leydig, Voit & Mayer, Ltd.

(57) ABSTRACT

A pressurized air assisted liquid spray nozzle assembly having a liquid spray nozzle having a downstream discharge orifice for discharging a solid stream of liquid, an air guide mounted in surrounding relation to a downstream end of said liquid spray nozzle, and an outer nozzle body disposed in surrounding relation to said air guide.

The air guide defines a first plurality of air passages for directing pressurized atomizing air transversely to liquid discharging from said liquid spray nozzle for atomizing the discharging liquid and a second plurality of air passages for directing shaping air tangentially to liquid discharging from said liquid spray nozzle for shaping the atomized liquid particles into a predetermined conical spray pattern.

18 Claims, 4 Drawing Sheets

FULL CONE AIR-ASSISTED SPRAY NOZZLE ASSEMBLY

BACKGROUND OF THE INVENTION

The present invention relates generally to liquid spray nozzle assemblies, and more particularly, to an improved spray nozzle assembly adapted for discharging full cone conical spray patterns.

BRIEF SUMMARY OF THE INVENTION

Presently, most spray nozzles that generate a conical spray discharge with liquid spray particles distributed throughout the spray pattern have an internal mix design wherein pressurized liquid and air streams intermix and pre-atomize the liquid in a mixing chamber internally within the spray nozzle. The pre-atomized liquid then is discharged from the nozzle through a plurality of circumferentially spaced discharge orifices with the multiplicity of discharging fine particle streams blending together to form a conical spray pattern. A disadvantage of such spray nozzle assemblies is that the individual discharging streams have a tendency to develop undesirable streaking which impedes uniform distribution and application of the liquid spray. Since the pressures of the liquid and air introduced into the internal mixing chamber must be substantially similar to prevent one from adversely affecting the other, the control of the discharging spray pattern also is limited. The atomized liquid also can set up within the internal mixing chamber and clog or impede operation, particularly when spraying more viscous liquids.

While external mix air atomizing spray nozzle assemblies are known in which a liquid flow stream is atomized by pressurized air at or immediately following discharge from a liquid discharge orifice of the nozzle, such spray nozzles have not been well suited for generating and spraying full cone spray patterns. Such external mix spray nozzles have been limited both in their ability to control spray particle distribution throughout the conical spray pattern and vary the angle of the conical discharge.

OBJECTS AND SUMMARY OF THE INVENTION

It is an object of the invention is to provide an improved pressurized air assisted liquid spray nozzle assembly adapted for more effectively producing full cone spray patterns with uniform liquid particle distribution across the pattern.

Another object is to provide a spray nozzle assembly as characterized above which is operable for generating conical spray patterns with a wider range of angles.

A further object is to provide a spray nozzle assembly of the foregoing type which can be operated at a wide range of different air and liquid pressures for enhanced control of the spray angle and liquid particle distribution of the conical spray discharge.

Yet another object is to provide a full cone spray nozzle assembly of the above kind which is effective for spraying viscous liquids without undesirable clogging.

Another object is to provide such a spray nozzle assembly which is relatively simple in construction and lends itself to economical manufacture.

Other objects and advantages of the invention will become apparent upon reading the following detailed description and upon reference to the drawings.

Figure 1:
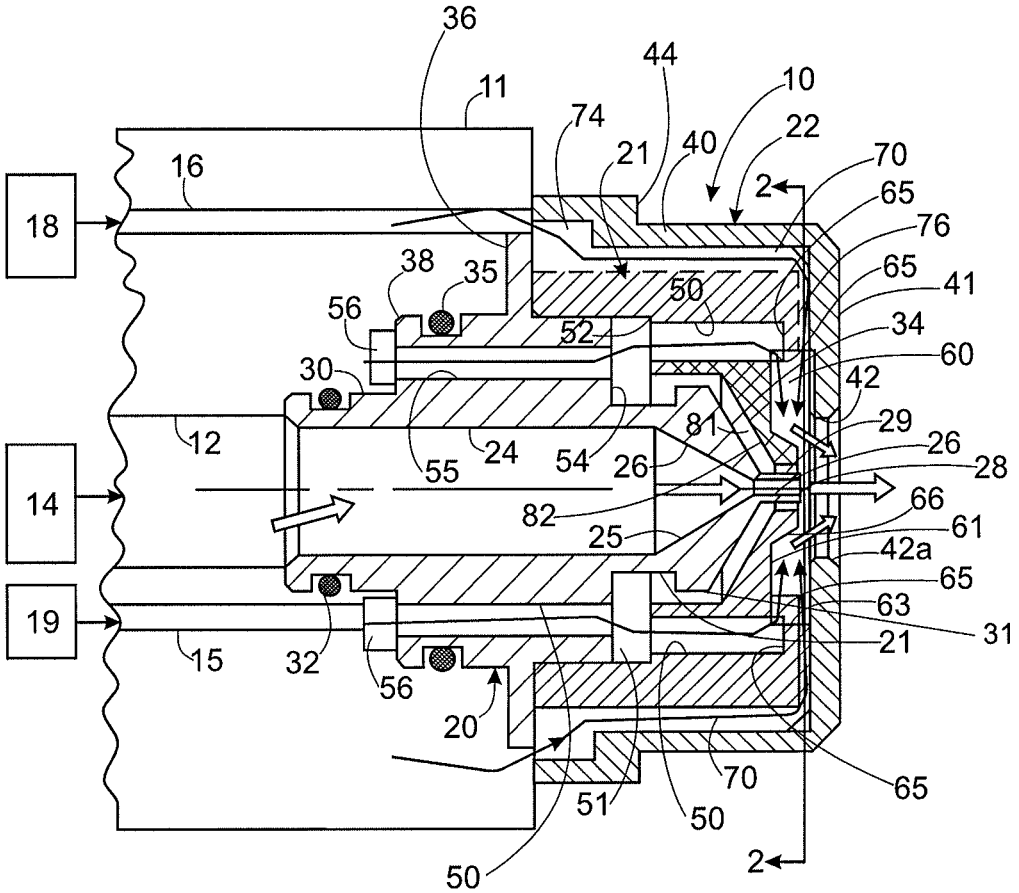
FIG. 1 is a longitudinal section of an illustrative pressurized air atomized liquid spray nozzle in accordance with the invention.
Figure 2:
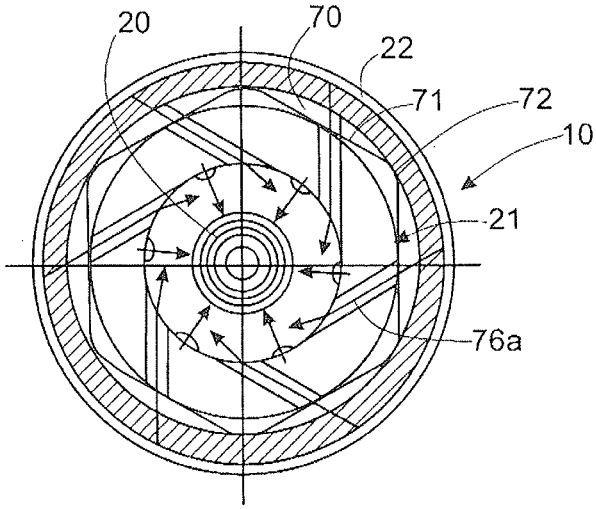
FIG. 2 is a vertical section taken in the plane of line 2-2 in FIG. 1.
Figure 3:
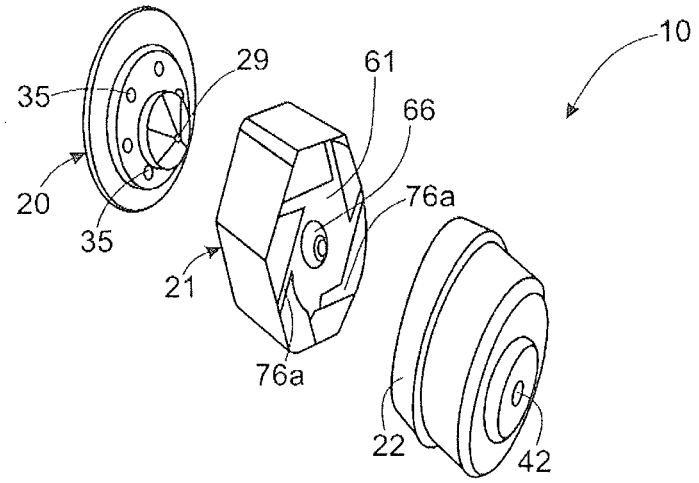
FIG. 3 is an exploded view of the illustrative spray nozzle assembly.
Figure 4:
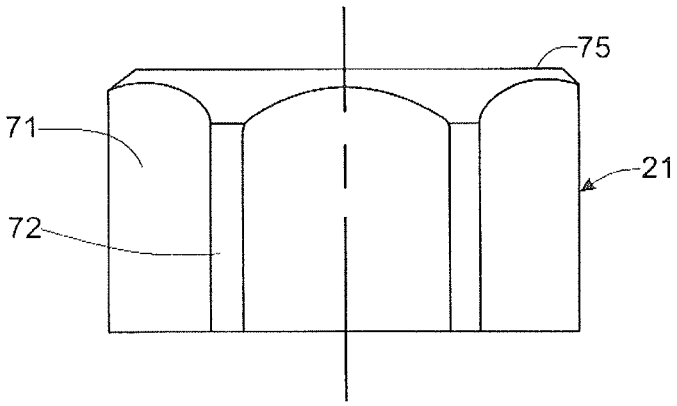
FIG. 4 is a side elevational view of an internal air guide of the illustrated spray nozzle assembly.
Figure 5:
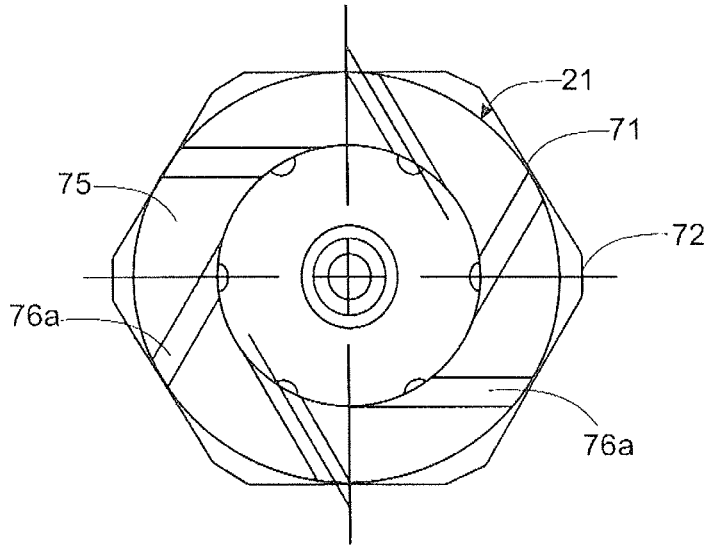
FIG. 5 is a top end view of the air guide shown in FIG. 4.
Figure 6:
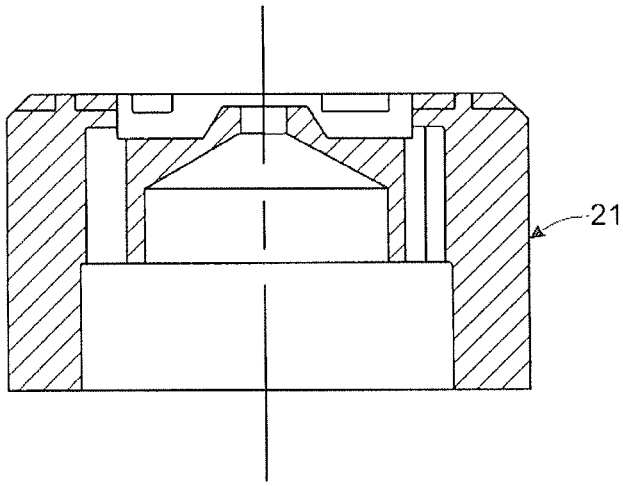
FIG. 6 is a vertical section of the air guide shown in FIG. 4.
Figure 7:
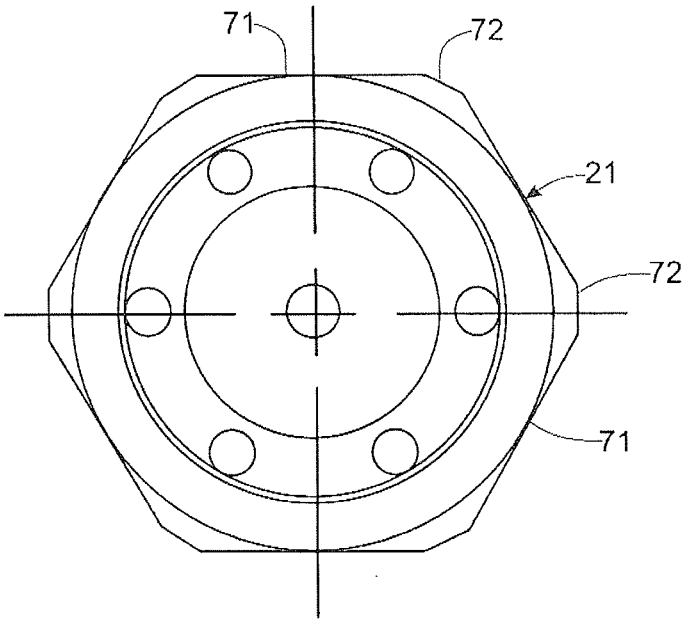
FIG. 7 is a bottom end view of the air guide shown in FIG. 4.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE PREFERRED EMBODIMENT

Referring now more particularly to the drawings, there is shown an illustrative pressurized air assisted liquid spray nozzle assembly 10 in accordance with the present invention. The spray nozzle assembly 10 in this case is mounted on a conventional spray gun or head 11 having a central liquid passage 12 connected to a pressurized liquid supply 14 and first and second air passages 15,16 disposed in circumferentially offset relation to each other for coupling to suitable pressurized air supplies 18,19.

The illustrated spray nozzle assembly 10 basically comprises an inner central liquid spray nozzle 20, an annular air guide or core 21 disposed in surrounding relation to a downstream end of the liquid spray nozzle 20, and a cup-shaped nozzle body or cap 22 disposed about the air guide 21. The liquid spray nozzle 20 has a central liquid passageway 24 having a downstream inwardly converging conical section 25 that communicates with a small diameter nozzling section 26 and liquid discharge orifice 28 defined by a forwardly extending nose portion 29 of the liquid spray nozzle 20. The liquid spray nozzle 20 in this case has relatively small diameter upstream and downstream end portions 30,31, respectively, with the upstream end portion 30 being disposed within a counter-bore of the head 11 and sealed by annular sealing ring 32. The downstream end portion 31 is formed with an inwardly converging conical section 34 from which the small diameter nose portion 29 extends. The illustrated liquid spray nozzle 20 has an enlarged diameter intermediate section 35 with a radially extending mounting and locating flange 36 positioned against an end-face of the head 11. An upstream end of the enlarged diameter central portion 35 is disposed within a second counter-bore of the head 11 and sealed by an annular sealing ring 38.

The nozzle body or cap 22 has an outer cylindrical side wall 40 and an end wall 41 formed has a central opening 42 coaxial with the liquid spray nozzle passageway 24 and discharge orifice 28. The cylindrical side wall 40 has an outwardly extending annular shoulder 44 adjacent an upstream end which is secured to the head 11 by inappropriate retention ring or the like.

In accordance with the illustrated embodiment, the air guide defines (1) a first plurality of air passages effective for directing pressurized atomizing air transversely to the solid liquid flow stream discharging from the liquid spray nozzle for pre-atomizing the liquid into fine liquid spray particles and (2) a second plurality of air passages for directing a plurality of shaping air streams tangentially to the discharging pre-atomized liquid for further atomizing the liquid and forming the liquid particles into a conical full cone spray pattern. The first plurality of air passages in this case are in the form of six circumferentially spaced passages 50 extending through the air guide in substantially parallel relation to the central liquid passageway 24. The first passages 50 have upstream ends which communicate with an annular manifold passage 51 defined by a counter-bore 52 in the upstream end of the air guide 21 and a downstream end wall 54 of the intermediate section 35 of the liquid spray nozzle 20, which in turn communicates through a plurality of circumferentially spaced longitudinal passageways 55 with an annual manifold passage 56 in the head 11, which in turn receives pressurized air from the air passage 15.

The downstream ends of the first plurality of air guide passages 50 communicate with a transverse annual passageway 60 defined between a recessed end face 61 of the air guide 21 formed by a counter-bore in the air guide and the end wall 41 of the nozzle body or cap 22. The transverse annular passageway 60 directs pressured atomizing air into converging transverse impingement with the solid liquid flow stream discharging from the liquid spray nozzle discharge orifice 28. The recessed end face 61 of the air guide 21 formed by a counter-bore 63 in this case has a diameter sized to intersect downstream ends of the plurality of first air guide passages 50 so as to define a plurality of circumferentially spaced atomizing air discharge orifices 64 adjacent transversely oriented end faces 65 of the passages 50 for directing the atomizing air in a radially inward direction. The counter bore 63 that defines the discharge orifices 64 preferably has an outer diameter that intersects the ends of the first passages 50 at locations radially inwardly of their respective longitudinal axes so that the passages 50 communicate with the transverse annular passage 60 through corners on the radially inward sides of the end faces 65 of the passages 50. The air guide 21 in this case has a central forwardly extending and inwardly tapered nose portion 66 surrounding the nose portion 29 of the liquid spray nozzle 20 for channeling the transversely directed atomizing air streams in slightly downstream angled relation to the liquid discharging to the liquid spray nozzle 20.

In carrying out the illustrated embodiment, the air guide 21 defines a second plurality of air passages which direct a plurality of tangentially directed shaping air streams in surrounding relation to the atomized liquid discharging from the nozzle for further atomizing and forming the discharging liquid spray into a well-defined conical spray pattern. To this end, in the illustrated embodiment, the air guide 21 has an outer hexagonal configuration defined by six flat surfaces 71 which define a corresponding number of circumferentially spaced peripheral air passages 70 between the air guide 21 and the outer cylindrical wall 40 of the nozzle body 22. Corners 72 of the joining flat surfaces 71 of the air guide 21 are rounded to facilitate close positioning against the inner surface of the cylindrical sidewall 40. The circumferentially spaced peripheral passages 70 in this case communicate with an air manifold chamber 74 that in turn communicates about the outer flange 36 of the liquid spray nozzle 20 with the pressurized air passage 16 in the head 11.

In keeping with this embodiment, an outer end face 75 of the air guide 21 and the nozzle body end wall 41 define a plurality of tangential passages 76 each communicating with a respective one of the peripheral passages 70 for directing pressurized shaping air streams tangentially about the atomized liquid discharging from the liquid spray nozzle 20 so as to both further atomize and create a whirling action that forms the discharging spray particles into a conical spray pattern. In this case, the end wall 75 of the air guide 21 is formed with tangentially directed grooves **76*a* which define the tangential air shaping passages 76 with the nozzle body end wall 41** against which the air cap abuts.

While the transverse atomizing air and tangential shaping air streams act upon the discharging liquid initially within the central aperture 42 of the air nozzle body 22, it has been found that the tangential shaping air, by its swirling direction, continues to shape and maintain the discharging spray into a well-defined conical spray pattern following discharge from the liquid spray nozzle. In the illustrated embodiment, the central nozzle body opening 42 terminates with an outwardly tapered chamfer **42*a***.

A unique feature of the pressurized air atomizing nozzle of the present invention with the combination of transverse atomizing and tangential shaping air discharge passages is the ability to maintain and control a full cone spray pattern with uniform liquid distribution across the pattern at a wide range of air and liquid pressure combinations. This is accomplished by selectively impinging the solid liquid flow stream exiting the discharge orifice of the liquid spray nozzle with a plurality, in this case six, transversely directed pressurized air streams and simultaneously controlling and shaping the atomized particles by the plurality, again in this case six, tangential pressurized air streams. The transverse pressurized air streams atomize the liquid on impact and the tangential air streams rotate the atomized droplets to form a uniform and controlled full cone spray pattern. The combination of direct impact and tangential rotation of the liquid stream has been found to have important utility in atomizing many types of liquids with a wide range of viscosities. This is possible because most of the atomization takes place outside the liquid spray nozzle in a fashion similar external mix atomizing spray nozzles, and hence, can be used with even highly viscous liquids without clogging or material build-up that impairs spray performance.

While in the illustrated embodiment, the nozzle assembly includes six passages for both channeling and directing pressurized atomizing and shaping air, alternatively greater or lesser numbers of passages may be utilized for particular spray applications. Preferably, between four and eight passages in each instance are employed.

In keeping with a further feature of this embodiment, the transverse air atomizing passages and the tangential shaping pressurized air passages may be controlled individually for particular spray applications. To this end, an illustrated embodiment, a separately controlled pressurized air supply 19 is provided for the transverse atomizing air passages and a separately controlled pressurized air supply 18 for the tangential shaping air.

In the illustrated embodiment, the liquid spray nozzle nose 29 and a central opening in the air guide 21 define an annular discharge passage 80 which communicates with the annular manifold air chamber 54 by one or more passages 81 defined between the liquid spray nozzle 20 and a downstream internal chamber 82 of the air guide 21. The annular pressurized air stream discharging axially from the passage 80 facilitates outward direction of the discharging liquid spray particles and maintains the nozzle clear of undesirable material build-up. Alternatively, the liquid spray nozzle nose 29 may be tightly disposed within the central air guide opening so that the discharging spray is controlled entirely by the transverse and shaping pressurized airstreams.

From the foregoing, it can be seen that the pressurized air assisted liquid spray nozzle of the present invention is adapted for more effectively and versably producing full cone spray patterns with liquid particle distribution throughout the pattern. By individually varying the pressure of atomizing air and shaping air, the spray nozzle further is operable for generating a wide range of conical spray angles. The spray nozzle further is effective for spraying viscous liquids without performance impeding clogging. Yet, the spray nozzle assembly is relatively simple in construction and lends itself to economical manufacture.

It will be understated that the use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A pressurized air assisted liquid spray nozzle assembly comprising:

a liquid spray nozzle having a central liquid passage for coupling with a pressurized liquid supply and a discharge orifice at a downstream end for discharging a constant stream of liquid;

an air guide mounted in surrounding relation to the downstream end of said liquid spray nozzle;

an outer nozzle body disposed in surrounding relation to said air guide having a central opening coaxial with said liquid spray nozzle central liquid passage and discharge orifice;

said air guide defining a first plurality of air passages for directing pressurized atomizing air in a radial direction transverse to liquid discharging from said liquid spray nozzle discharge orifice for interacting and atomizing the discharging liquid into liquid particles following discharge from said spray nozzle discharge orifice; and said air guide defining a second plurality of air passages for directing shaping air tangentially to liquid discharging from said liquid spray nozzle and atomized by said atomizing air following discharge from said spray nozzle discharge orifice for shaping the atomized liquid particles into a predetermined conical spray pattern.

2. The pressurized air assisted liquid spray nozzle assembly of claim 1 in which said first plurality of air passages include a plurality of circumferentially spaced passages extending through said air guide.

3. The pressurized air assisted liquid spray nozzle assembly of claim 2 in which said outer nozzle body and said air guide define a radial air direction passage for receiving pressurized atomizing air from said circumferentially spaced air guide passages and directing atomizing air into transverse impinging relation to liquid discharging from said liquid spray nozzle discharge orifice.

4. The pressurized air assisted liquid spray nozzle assembly of claim 1 in which said plurality of second air passages are defined between said air guide and said outer nozzle body.

5. The pressurized air assisted liquid spray nozzle assembly of claim 1 in which said outer nozzle body has a cylindrical side wall disposed in surrounding relation to said air guide and a downstream end wall formed with said central opening, and said second air guide passages include a plurality of circumferentially spaced air passages defined between an outer periphery said air guide and an inner side of said cylindrical side wall of said nozzle body.

6. The pressurized air assisted liquid spray nozzle assembly of claim 1 in which said outer nozzle body has a cylindrical side wall and a downstream end wall formed with said central opening, and said second plurality of passages include a plurality of passages formed between a downstream end wall of said air guide and the end wall of said outer nozzle body oriented for directing pressurized shaping air in tangential relation to liquid discharging from said liquid spray nozzle discharge orifice.

7. The pressurized air assisted liquid spray nozzle assembly of claim 6 in which air guide end has a central frustro conical nose portion for directing atomizing air in transverse relation at an acute angle to liquid discharging from said liquid spray nozzle discharge orifice.

8. The pressurized air assisted liquid spray nozzle assembly of claim 7 in which said outer nozzle body and air guide nose portions are disposed adjacent an upstream side of said nozzle body central opening.

9. The pressurized air assisted liquid spray nozzle assembly of claim 1 including a first pressurized air supply for directing pressurized atomizing air to said first plurality of air passages, and a second pressurized air supply different from said first air supply for supplying pressurized shaping air to said second plurality of air passages.

10. The pressurized air assisted liquid spray nozzle assembly of claim 9 in which said first air supply is operable for directing atomizing air to said first plurality of passages at a pressure different from the pressure said second air supply directs pressurized air to said second plurality of passages.

11. The pressurized air assisted liquid spray nozzle assembly of claim 1 in which said liquid spray nozzle has a downstream nose portion that defines a liquid nozzling section of said liquid passage way and said discharge orifice.

12. The pressurized air assisted liquid spray nozzle assembly of claim 11 in which said air guide has a central opening in coaxial relation to said liquid spray nozzle nose portion for defining an annular air passage communicating with a pressurized air supply for directing an annular axially directed air stream about liquid discharging from said liquid spray nozzle discharge orifice.

13. The pressurized air assisted liquid spray nozzle assembly of claim 1 in which said liquid spray nozzle has an enlarged diameter intermediate portion formed with a plurality of atomizing air passages communicating between a pressurized air supply and said first plurality of air passages defined by said air guide.

14. The pressurized air assisted liquid spray nozzle assembly of claim 1 in which said first plurality of air passages include a plurality of circumferentially spaced passages extending through said air guide which each have an end wall in a plane transverse to a direction of liquid from said liquid spray nozzle discharge orifice and a radial discharge orifice in an inner radial side of the respective circumferentially spaced passage for directing atomizing air radially inwardly toward liquid discharging from said liquid spray nozzle discharge orifice.

15. The pressurized air assisted liquid spray nozzle assembly of claim 14 in which said radial discharge orifices are defined by a counter bore in a downstream end of said air guide which intersect said circumferentially spaced passages at a location radially inwardly of their respective center lines.

16. The pressurized air assisted liquid spray nozzle assembly of claim 1 in which said air cap is an integral one piece part positioned over said spray nozzle.

17. A pressurized air assisted liquid spray nozzle assembly comprising:

a liquid spray nozzle having a central liquid passage for coupling with a pressurized liquid supply and a downstream discharge orifice for discharging a constant stream of liquid;

an air guide mounted in surrounding relation to a downstream end of said liquid spray nozzle;

an outer nozzle body end cap disposed in surrounding relation to said air guide, said nozzle body end cap having a downstream end wall formed with a central opening coaxial with said liquid spray nozzle central liquid passage and discharge orifice;

said air guide having a downstream end wall which together with said downstream end wall of said outer nozzle body end cap define an annular passage oriented transversely to liquid discharging from said spray nozzle for directing pressured atomizing air transversely to liquid discharging from said liquid spray nozzle discharge orifice for interacting and atomizing the discharging liquid into liquid particles following discharge from said spray nozzle discharge orifice; and said air guide and outer nozzle body end cap end wall defining a plurality of tangentially oriented air passages for directing shaping air tangentially to liquid discharging from said liquid spray nozzle and atomized by said atomizing air following discharge from said spray nozzle discharge orifice for shaping the atomized liquid particles into a predetermined conical spray pattern.

18. A pressurized air assisted liquid spray nozzle assembly comprising:

a liquid spray nozzle having a central liquid passage for coupling with a pressurized liquid supply and a downstream discharge orifice for discharging a solid stream of liquid;

an air guide mounted in surrounding relation to a downstream end of said liquid spray nozzle;

an outer nozzle body disposed in surrounding relation to said air guide having a central opening coaxial with said liquid spray nozzle central liquid passage and discharge orifice;

said air guide defining a first plurality of air passages for directing pressurized atomizing air transversely to liquid discharging from said liquid spray nozzle discharge orifice for atomizing the discharging liquid into liquid particles;

said air guide defining a second plurality of air passages for directing shaping air tangentially to liquid discharging from said liquid spray nozzle and atomized by said atomizing air for shaping the atomized liquid particles into a predetermined conical spray pattern; and said liquid spray nozzle having an enlarged diameter intermediate portion formed with a plurality of atomizing air passages communicating between a pressurized air supply and said first plurality of air passages defined by said air guide.

* * * * *